United States Patent [19]

Gottemoller

[11] Patent Number: 5,011,371

[45] **Date of Patent: * Apr. 30, 1991**

[54] CENTRIFUGAL COMPRESSOR/PUMP WITH FLUID DYNAMICALLY VARIABLE GEOMETRY DIFFUSER

[75] Inventor: Paul Gottemoller, Lockport, Ill.

[73] Assignee: General Motors Corporation, Detroit, Mich.

[ * ] Notice: The portion of the term of this patent subsequent to Mar. 28, 2006 has been disclaimed.

[21] Appl. No.: 322,751

[22] Filed: Mar. 13, 1989

Related U.S. Application Data

[63] Continuation of Ser. No. 44,008, Apr. 29, 1987, Pat. No. 4,815,935.

[51] Int. Cl.[5] ..... F04D 1/00

[52] U.S. Cl. ..... 415/211.1; 415/211.2; 415/914

[58] Field of Search ..... 415/208.1, 208.2, 208.3, 415/211.1, 211.2, 914

[56] References Cited

U.S. PATENT DOCUMENTS

| | | | |
|---|---|---|---|
| 3,699,055 | 2/1972 | Davis | 415/914 |
| 3,719,430 | 3/1973 | Blair et al. | 415/208.3 |
| 4,455,121 | 6/1984 | Jen | 415/208.5 |
| 4,815,935 | 3/1989 | Gottemoller | 415/211.1 |

FOREIGN PATENT DOCUMENTS

| | | | |
|---|---|---|---|
| 162580 | 9/1903 | Fed. Rep. of Germany | 415/914 |
| 709266 | 7/1941 | Fed. Rep. of Germany | 415/211.1 |
| 889262 | 7/1953 | Fed. Rep. of Germany | 415/211.1 |
| 581325 | 11/1977 | U.S.S.R. | 415/211.1 |
| 864645 | 4/1961 | United Kingdom | 415/914 |

*Primary Examiner*—John T. Kwon

*Attorney, Agent, or Firm*—Robert J. Outland

[57] ABSTRACT

A centrifugal fluid machine such as a pump or compressor has a diffuser with fixed vane geometry which provides significantly increased range, as compared to conventional fixed geometry diffusers, by developing what appear to be flow accelerating stall bubbles in the diffuser throat that forestall the onset of surge in the portion of the operating range near and approaching the surge point. The stall bubbles are created by fixing the suction sides of the vanes, relative to the flow impinging upon their leading edges at angles slightly more radial than is conventional, thereby creating higher than normal angles of incidence with the flow delivered by the impeller.

8 Claims, 9 Drawing Sheets

CENTRIFUGAL COMPRESSOR/PUMP WITH FLUID DYNAMICALLY VARIABLE GEOMETRY DIFFUSER

CROSS-REFERENCE TO RELATED APPLICATION

This application is a continuation of U.S. Ser. No. 044,008 filed Apr. 29, 1987, now U.S. Pat. No. 4,815,935.

TECHNICAL FIELD

This invention relates to centrifugal compressors such as for engine superchargers, turbochargers, gas turbines, gas processors and other applications and, more particularly, to centrifugal compressors having vaned diffusers. The invention also relates to centrifugal radial flow and mixed flow pumps of the diffuser type, sometimes called diffuser pumps or turbine pumps and which may be used for pumping liquids. Such machines are for convenience interchangeably referred to herein as compressor/pumps or fluid machines.

BACKGROUND

It is known in the art relating to fixed geometry mixed and radial flow dynamic gas compressors, generally referred to as centrifugal compressors, that the differential pressure, or pressure ratio, across a compressor, the efficiency and the operating flow range as a percentage of the maximum or choke flow are determined in part by the type and geometry of the diffuser used in the assembly. In general, so called vaneless diffusers provide the highest operating range but the lowest maximum pressure ratio and efficiency. Diffusers with special air foil shaped vanes improve the maximum pressure ratio and efficiency with some reduction in the operating range. Finally, diffusers with generally wedge shaped straight sided blades, referred to as the straight island type, generally provide the highest pressure ratio and efficiency at the expense of still further reduction in the operating range.

Mechanically variable geometry diffusers for centrifugal compressors have been considered in the past to provide a wide operating range. Variable geometry is achieved by pivoting the diffuser vanes to match the exit angle of the flow from the impeller and by adjusting the mechanical diffuser throat area. These adjustments permit greater flow under choke conditions while reducing the flow at which surge occurs. Choke flow is increased by causing the diffuser throat area to be larger at this condition. The flow rate at which surge occurs is reduced when the diffuser throat area is reduced by pivoting the diffuser vanes to match the more tangential exit flow angle from the impeller at the lower flow conditions.

There are two major drawbacks to a mechanically variable geometry system. First, a control system is required to move and fix the positions of the diffuser vanes under the various operating conditions. Second, it is difficult to seal the edges of the movable diffuser vanes which is necessary to avoid a loss in efficiency.

In general, the statements in this section relating to centrifugal compressors are believed to be also applicable to centrifugal pumps, except that the term "surge" should be replaced by "instability" when referring to pumps. As used in the title and hereafter in the specification and claims.

The terms "compressor/pump" and fluid machine are interchangeably is used to designate that class of machines of similar design which when used to pump and compress so-called "compressible fluids" such as gases is generally referred to as a compressor and when used with so-called "incompressible fluids" such as liquids is generally referred to as a pump, The term "surge/instability" is used to designate that condition of compressor/pump machines which results in significant and rapid changes in flow and/or pressure of working fluid in the machine and occurs near the points of minimum stable through flow of fluid obtainable under the particular speed and pressure conditions, and The term "fluid" is intended to refer to a gas or compressible fluid when considered in relation to the operation of a compressor and to a liquid or incompressible fluid when considered in relation to the operation of a pump.

SUMMARY OF THE INVENTION

The present invention provides a centrifugal fluid machine or compressor/pump having a diffuser with fixed vane geometry which provides significantly increased range, as compared to conventional fixed geometry diffusers. This is accomplished by developing what appear to be flow accelerating stall bubbles that forestall the onset of surge/instability in the portion of the operating range near and approaching the surge/instability point. The stall bubbles are created by fixing the suction sides of the vanes, relative to the flow impinging upon their leading edges near the surge/instability point, at an angle slightly more radial than is conventional, thereby creating higher than normal angles of incidence with the flow delivered by the impeller.

The optimum incidence angle may vary with differing compressor/pump configurations; however, in certain developed embodiments, it has been advantageously established in the range of from 5-9 degrees and preferably about 7 degrees while the comparative incidence angle for similar conventionally designed diffusers fell in the range from about 1-1/2 to-3-1/2 degrees. This stall bubble creating diffuser design according to the invention, which I have called an aerodynamically (or fluid dynamically) variable geometry diffuser (AVGD), does not have the problems of mechanically variable geometry diffusers and it is less expensive to make since there are no moving parts.

The principal on which I understand the AVGD to operate is the creation of stall bubbles, usually on the hub side of the diffuser throat, i.e. in the throats of the individual diffuser passages, in the low end of the flow range. It is also possible to create stall bubbles on the shroud side of the diffuser throat, but this has, so far, not been found to be advantageous. The stall bubbles are believed to be small pockets of stagnant or recirculating flow lying along the suction sides of the vanes near their leading edges. As the operating point is moved to lower flows, the stall bubbles grow in each of the passages in the diffuser throat, thereby effectively reducing the aerodynamic diffuser throat area and increasing the velocity of gas in the remaining area of each passage throat not blocked by its stall bubble.

As a result, the onset of surge/instability occurs at a much lower flow than would otherwise be possible. On the high flow end of operation, the stall bubbles do not exist. Rather, because of the somewhat steeper vane angle of the AVGD design, the diffuser throat area is larger than that of a conventional diffuser, about 23% in a particular instance. Because of this larger throat area, choke flow and operating range are both increased. In one of the instances referred to, a choke flow of about 17% higher than a traditionally matched diffuser was obtained.

Thus, the characteristics and results which identify the unique features of the aerodynamically variable geometry diffuser (AVGD) include the following:

1) Stall bubbles are created in the diffuser throat, developing from the suction sides of the vanes during operation near the surge/instability point of the operating range, thereby forestalling the onset of surge/instability to a lower mass flow rate than would otherwise be obtained.
2) The measured throat area of the diffuser is on the order the 23% larger than that of a traditional design. In a specific embodiment the ratio of the total vaned diffuser throat area divided by the impeller outlet (or exit) area in a traditional design was calculated as 0.467. Comparatively the ratio of the AVGD design for the improved version of the same compressor resulted in a diffuser throat to impeller outlet area ratio of 0.575. These areas are determined by summing the minimum cross-sectional areas of the individual impeller and diffuser passages.
3) The surge/instability line on a flow chart for a compressor/pump with an AVGD remains fixed at a low flow and high pressure ratio characteristic similar to the case for a traditionally matched diffuser with a much smaller throat area and much lower choke flow.

These and other features and advantages of the invention will be more fully understood from the following description of certain specific embodiments of the invention taken together with the drawings.

BRIEF DRAWING DESCRIPTION

Figure 4:
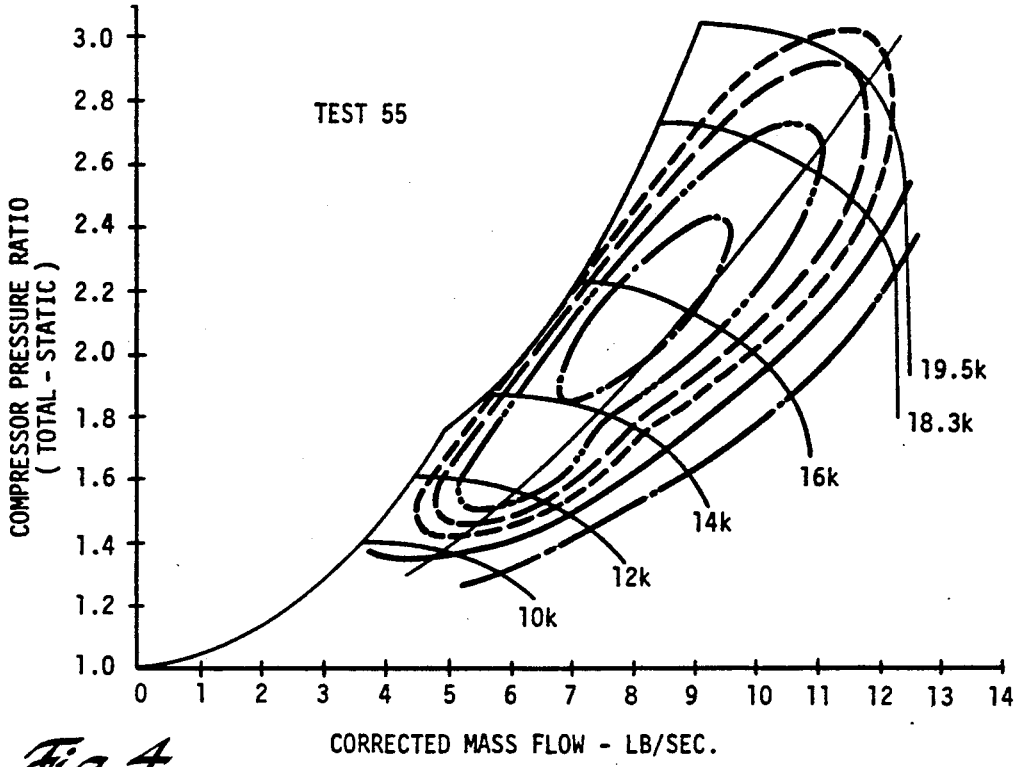
FIG. 4 is a graphical compressor map of pressure ratio versus mass flow for a compressor of the type shown in FIGS. 1 and 2 formed according to the invention.
Figure 7:
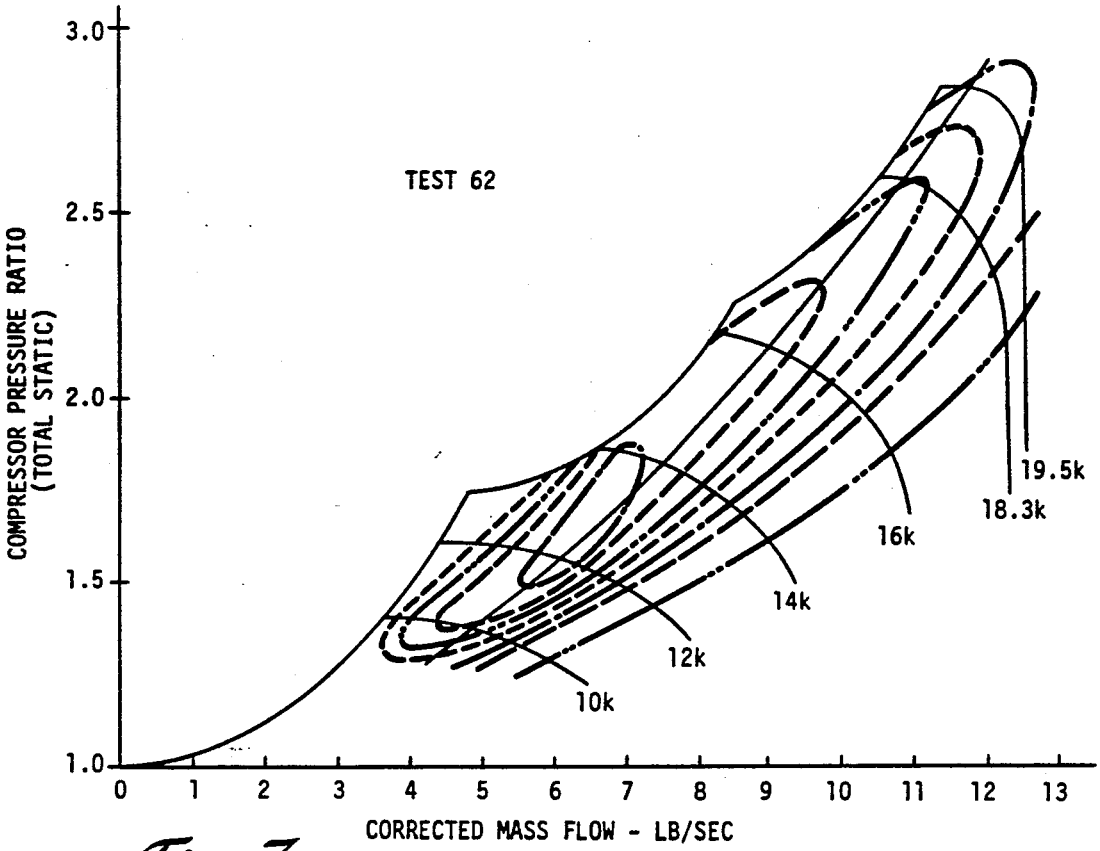
FIG. 7 is a compressor map similar to FIG. 4 but showing the characteristics resulting from a modified diffuser.
Figure 9:
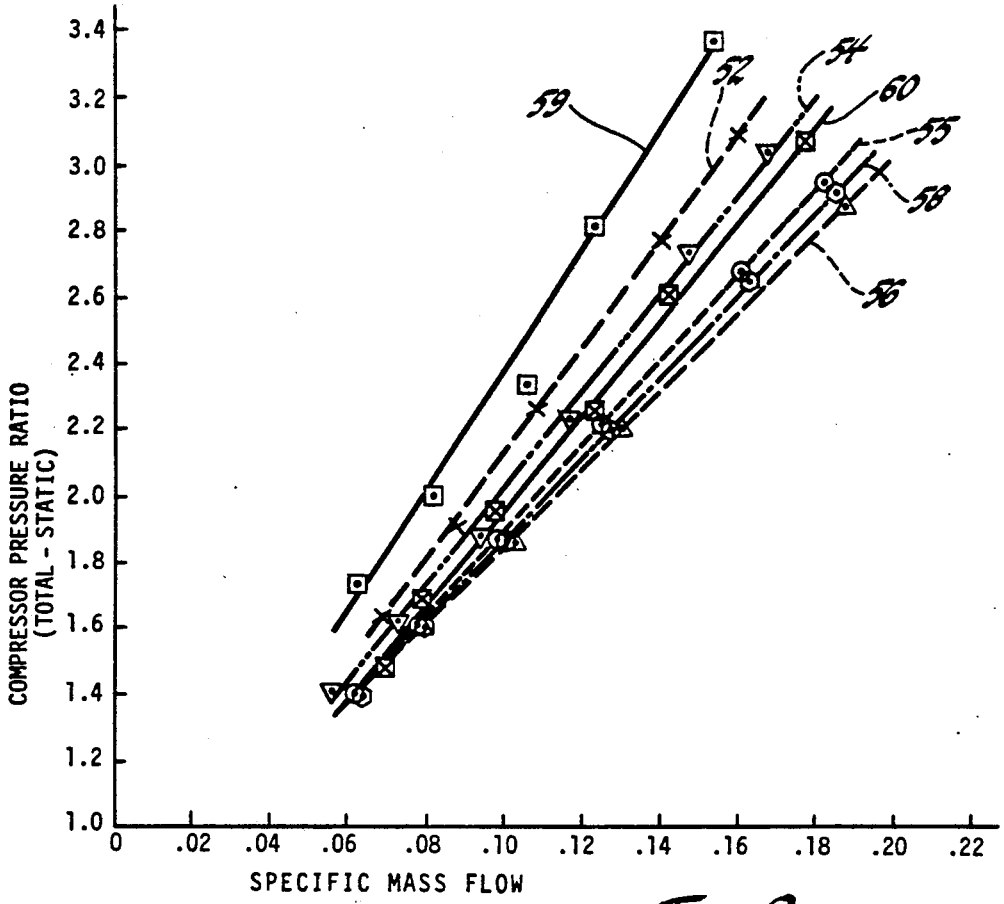
FIG. 9 is a plot of pressure ratio versus specific mass flow, where the static pressure on the shroud side is equal to the total pressure on the hub side of the diffuser throat, comparing tests of a number of differing compressor and diffuser configurations.
Figure 10:
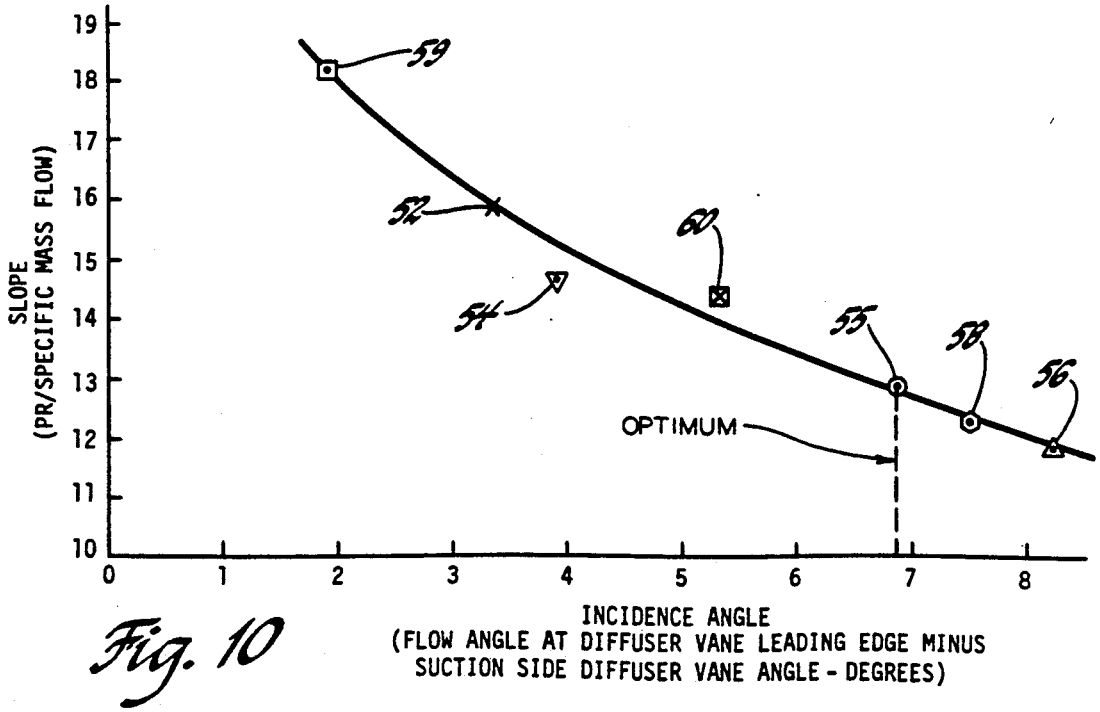
Figure 11:
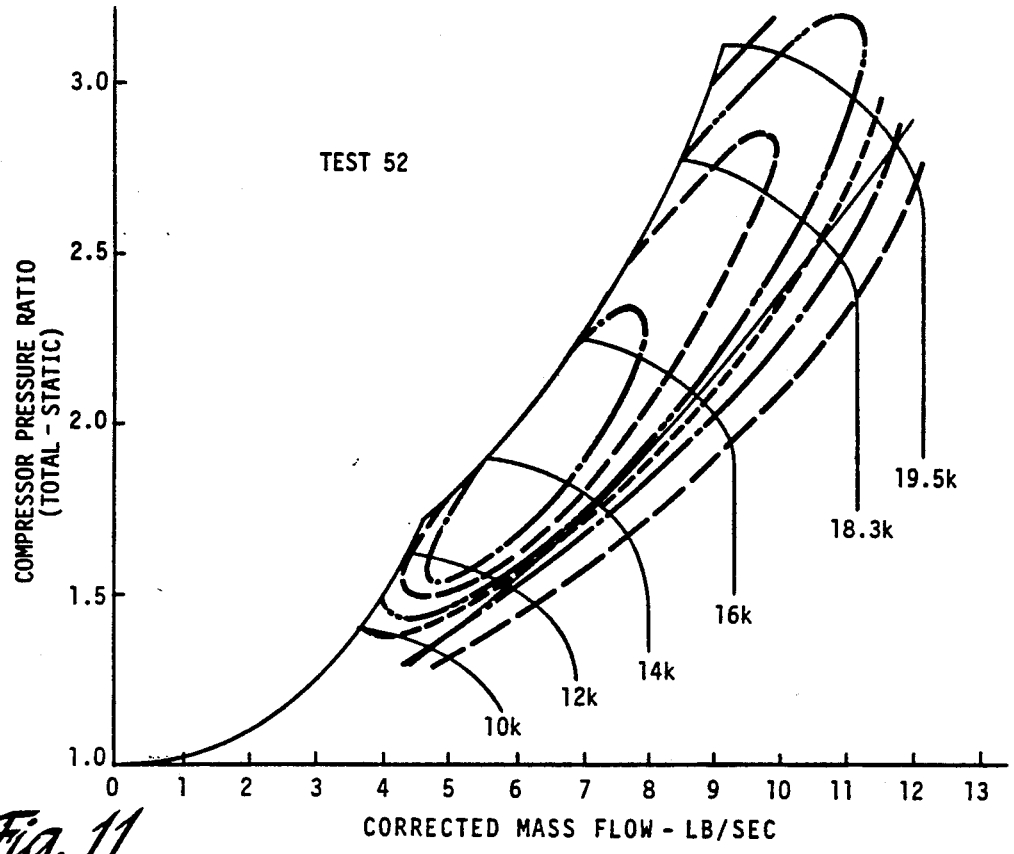
Figure 12:
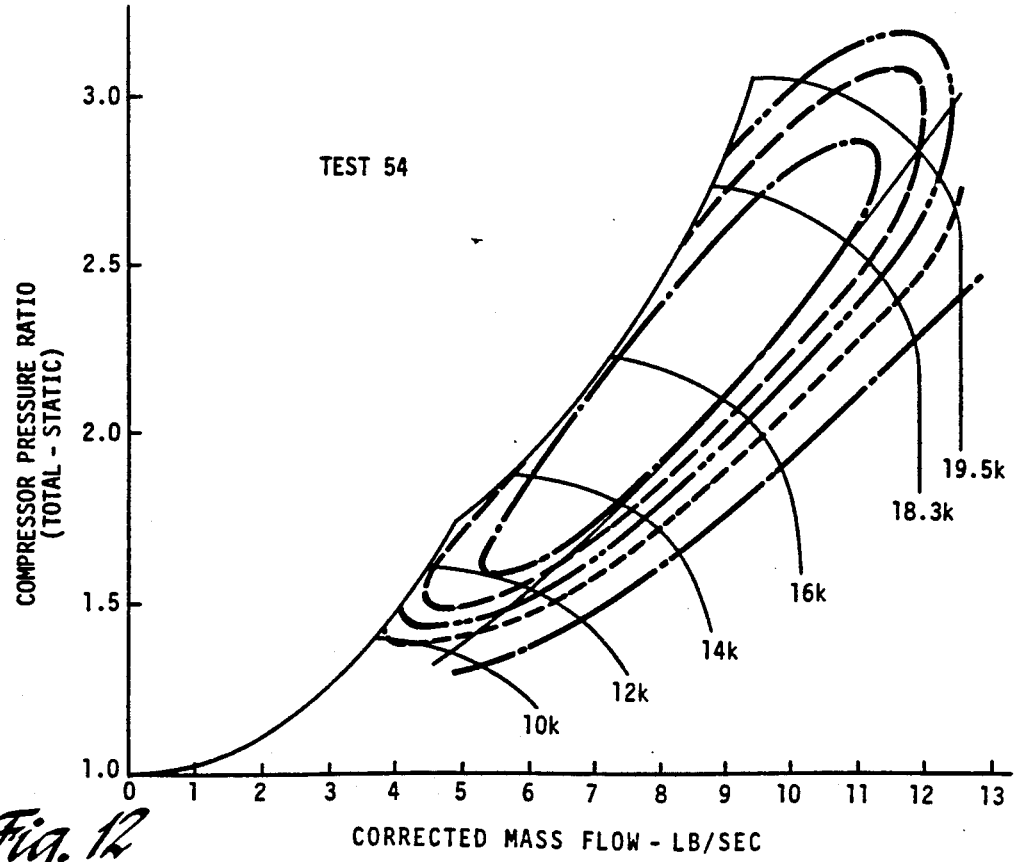
Figure 13:
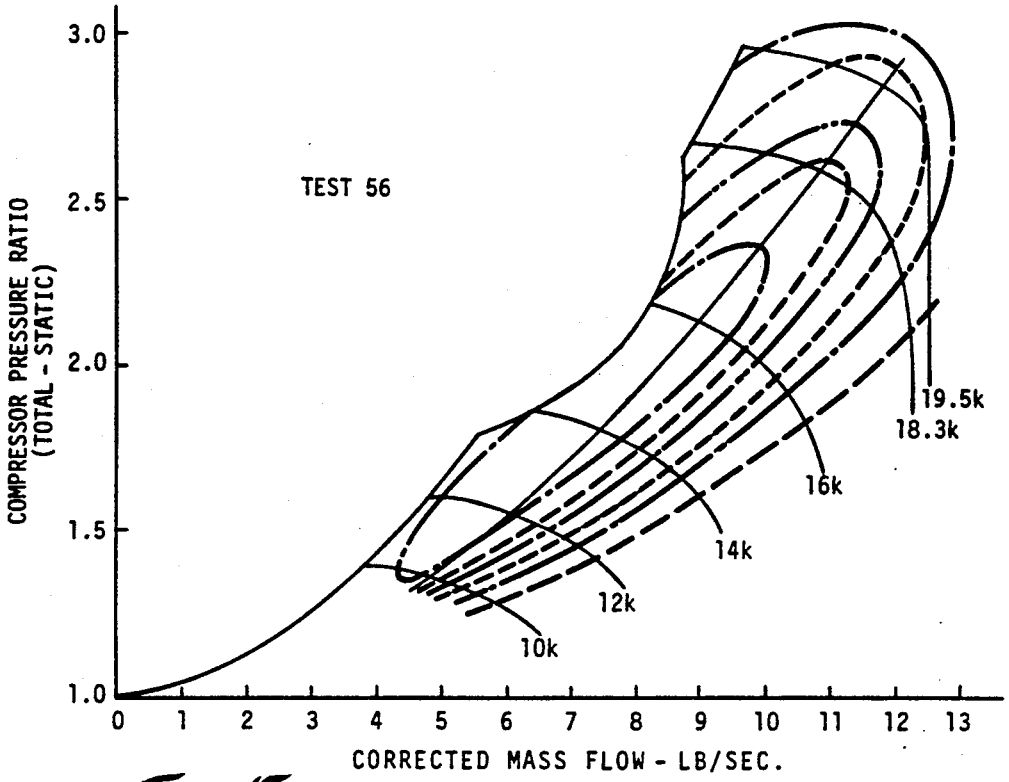
Figure 14:
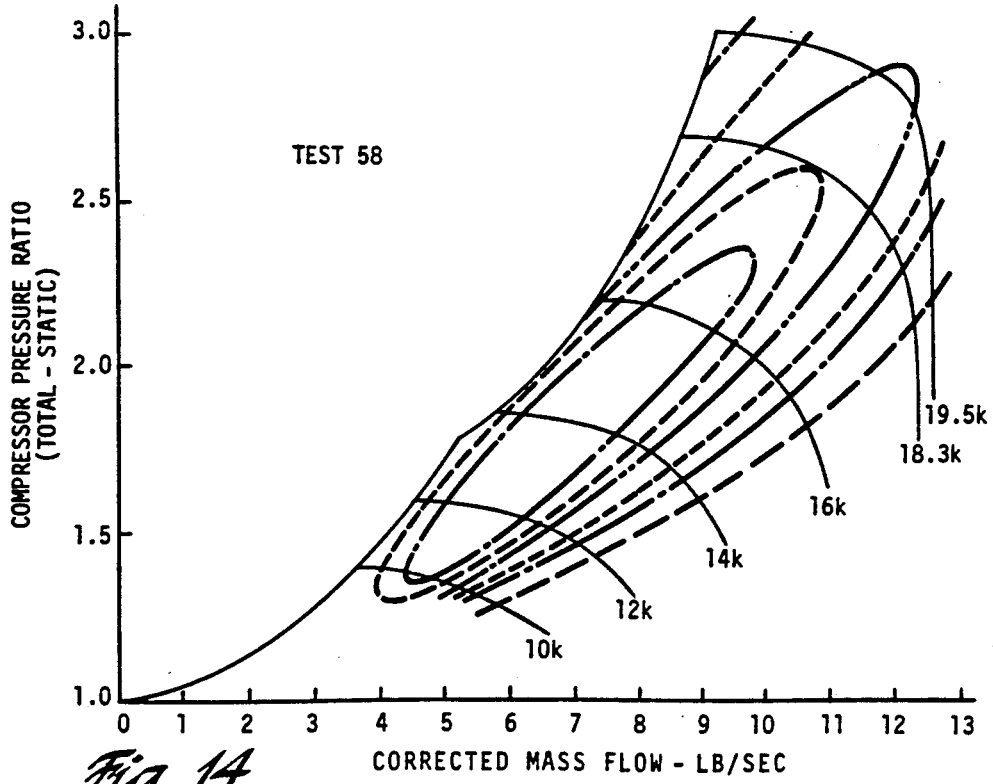
Figure 15:
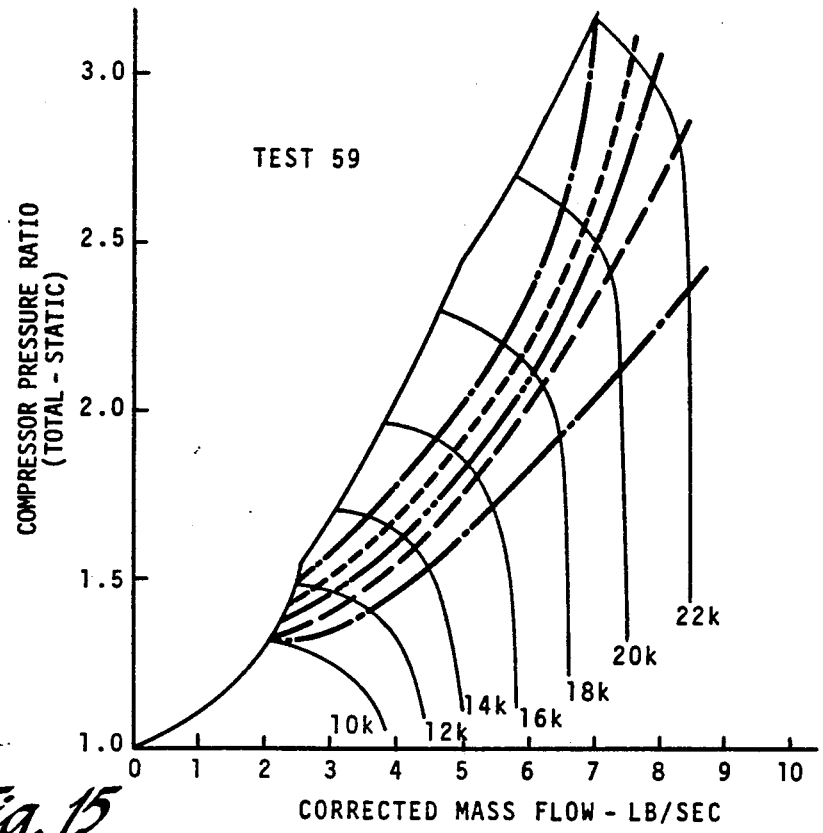
Figure 16:
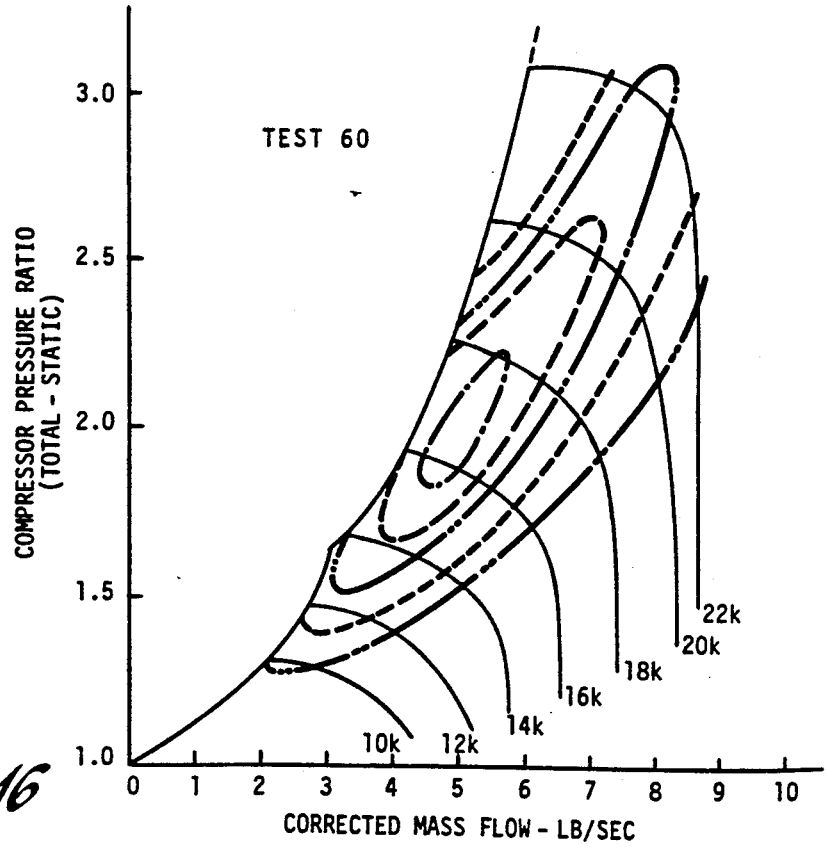

FIG. 10 is a graph of the slopes of the tests plotted in FIG. 9 versus the incidence angles for those tests; and FIGS. 11 through 16 are compressor maps similar to FIGS. 4 and 7 and showing the characteristics of the differing compressor configurations used in the tests compared in FIGS. 9 and 10.

DETAILED DESCRIPTION

Referring now to the drawings in detail, numeral 10 generally indicates a portion of a diesel engine turbocharger including a radial flow centrifugal compressor generally indicated by numeral 11. The compressor includes a housing 12 and a separable cover 14 which together define a peripheral scroll chamber 15 for the collection and distribution of pressurized charging air delivered by the compressor.

Within the housing 12 is supported a shaft 16 having a splined end on which there is carried an impeller 18 rotatable with the shaft. The impeller includes a hub 19 from which extend a plurality backswept blades 20 that define a plurality of passages 22 outwardly closed by a shroud 23 that is attached to the cover 14. An inlet extension 24 on the shroud and a nose cone 26 on the impeller define a common entry to the passages 22 for gas delivered through means, not shown, connecting the inlet extension 24 with intake air filtration means or the like. The direction of the passages 22 changes from the entry at the nose cone, where it is generally axial, through a curving path along the hub 19 into an outwardly radial direction which terminates at the outer diameter of the impeller at a peripheral annular outlet 27.

Surrounding the outlet and extending between it and the scroll passage 15 is a diffuser 28 comprising a cast body, including a side mounting plate 30 with a plurality of integral machined vanes 31 extending therefrom, assembled together with a generally flat cover plate 32 closing the sides of the vanes opposite the mounting plate and generally aligned with the hub side of the impeller.

The diffuser vanes and their associated mounting and cover plates form a plurality of angularly disposed straight sided diffuser passages 34 of outwardly increasing area for efficiently converting the dynamic energy of gas delivered from the compressor into pressure energy in known fashion. For this purpose the vanes have relatively sharp inner or leading edges 35 and thicken outwardly to define wedge shaped straight sided islands between the diffuser passages 34.

Figure 1:
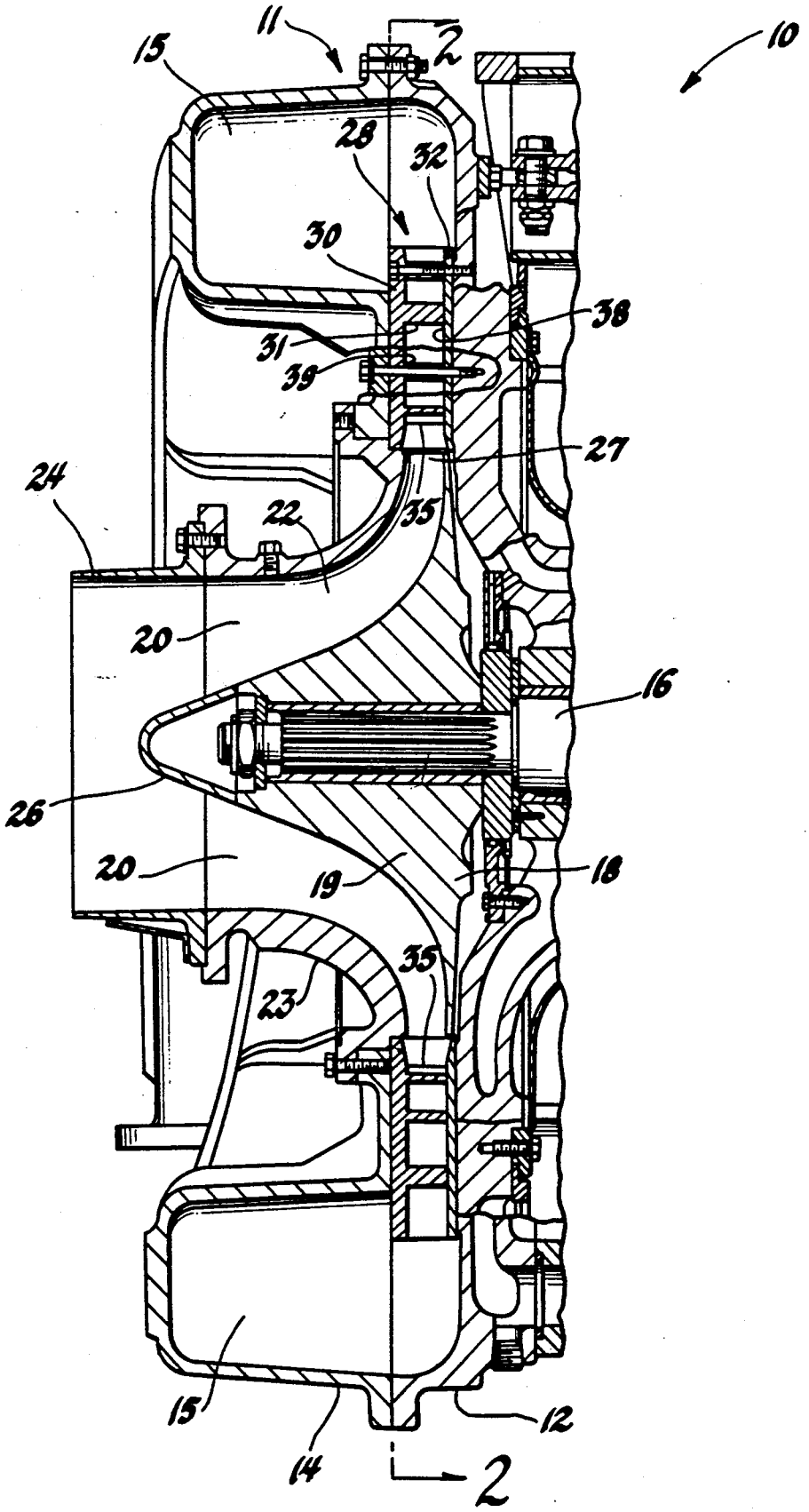
FIG. 1 is a longitudinal cross-sectional view of the centrifugal compressor portion of a diesel engine turbocharger.
Figure 2:
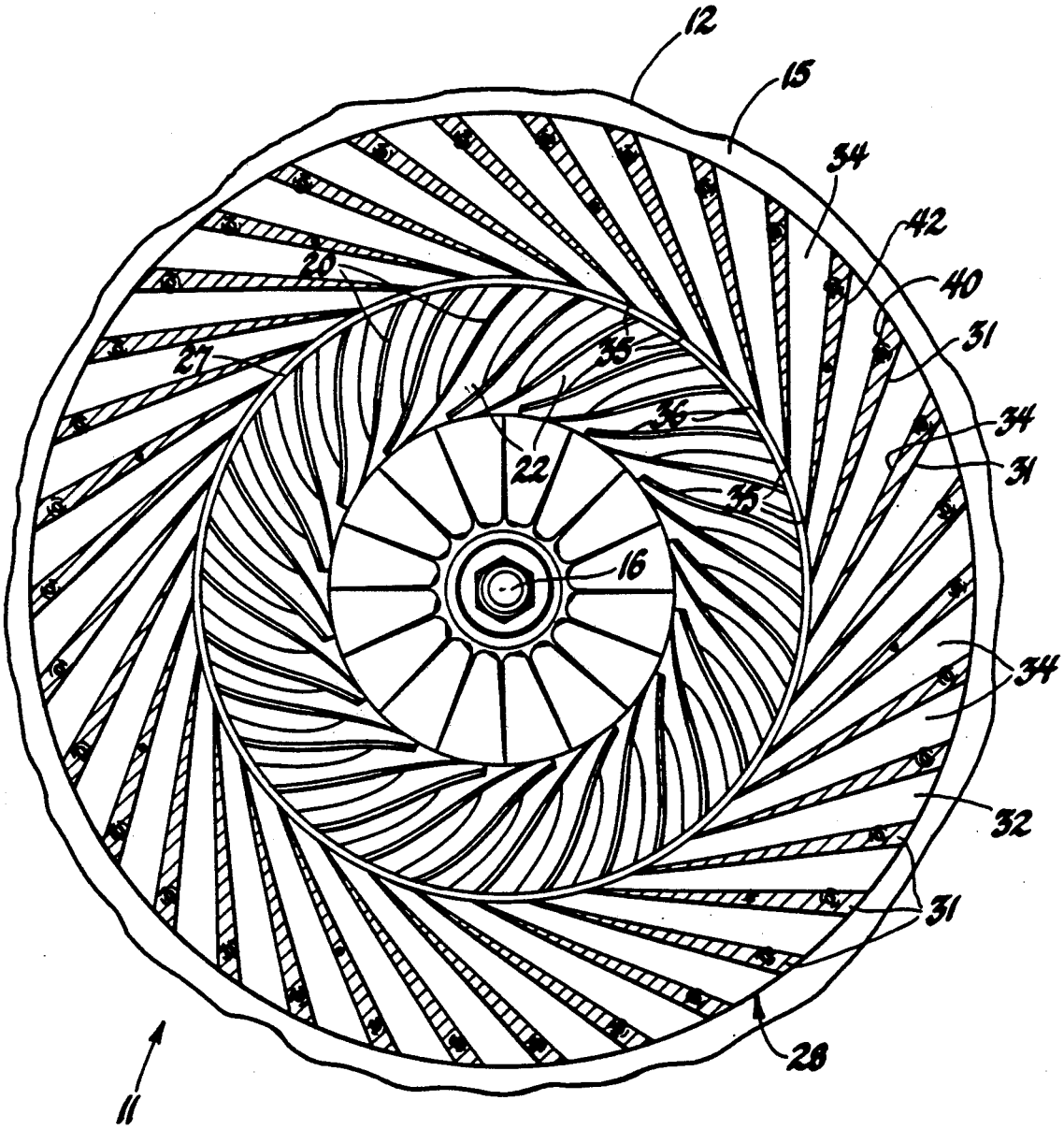
FIG. 2 is a transverse cross-sectional view of the compressor from the plane of the line 2—2 of FIG. 1.

Each diffuser passage 34, as illustrated, includes four sides, although they need not be planar sides as shown in the drawings. These sides include a hub side 38 defined by the inner surface of the cover plate 32, a shroud side 39 defined by the inner surface of the mounting plate 30, a suction side 40 defined by the trailing side of the associated vane leading in the direction of impeller rotation and a pressure side 42 defined by the leading side of the associated vane trailing in the direction of impeller rotation. It should be noted that, in the cross-sectional view of FIG. 2, the direction of rotation of the impeller is counterclockwise.

The gas flow leaving the radial outer edge of the impeller has a substantial tangential component in the direction of impeller rotation. Thus, the diffuser vanes 31 and passages 34 are oriented with a large tangential component as well as a substantial radial component in order to orient them generally in the direction of gas flow as it approaches the leading edges 35 of the diffuser vanes.

In diffuser design, it is conventional practice that the passage direction is very nearly aligned with the direction of incoming gas flow when the compressor is at or near the limit of its maximum pressure ratio development and the flow approaches a minimum, known as the surge point, for a particular operating speed. Obviously then, at higher flows, and lower pressure ratios, the direction of gas flow entering the diffuser will be increasingly radial and efficiency at the maximum flow condition will be reduced from what it would be if the vanes were set in a somewhat more radial direction. A more radial setting also has the advantage of increasing the area of the passages somewhat so as to provide the capability of greater gas flow before a choked, or flow limiting, condition in the diffuser is reached.

Nevertheless, in conventional diffuser design, the suction sides of the passages or vanes are disposed at angles of incidence only slightly more radial than the direction of entering gas flow near the surge point. In particular embodiments of conventional diffusers, the incidence angles were determined to fall in the range of from 3.4 to 1.5 degrees, or roughly about 1–4 degrees, which was intended to maintain a relatively smooth entry of gas into the diffuser even under the near surge conditions found in the compressor.

Figure 3:
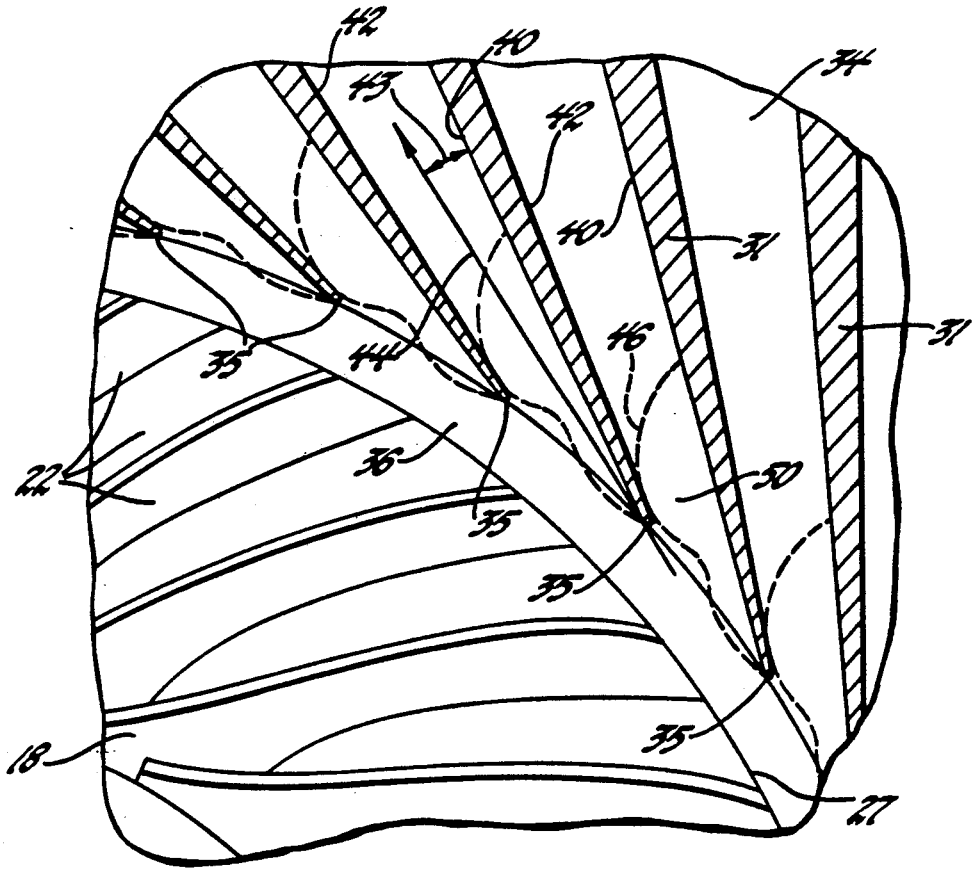
FIG. 3 is an enlargement of a portion of FIG. 2 showing further details of the construction.

As will be more fully explained subsequently, the present invention differs in that, as illustrated in FIG. 3, the angle of incidence 43 between the suction side 40 of each vane and the gas flow direction entering the adjacent diffuser passage near the surge point and indicated by the line 44 is increased significantly to a point where a stall bubble 46 is developed on the hub side of the diffuser passage as the surge point is approached. This stall bubble 46 is believed to involve recirculation of gases in a part of the diffuser passage adjacent the hub. This effectively reduces the flow area in the passage, thereby increasing the flow velocity of the gases passing through the remaining portions of the passage and leading to a shifting of the surge point to a lower compressor flow. The operating range of the compressor, defined as the differential in flow between choke and surge divided by the choke flow, is thereby substantially increased.

Since the flow angle of gases entering the diffuser vanes is a function of several variables, it is not possible to indicate a specific vane angle which is ideal for all the differing sizes and configurations of compressors and their matching diffusers in which the stall bubble concept may be utilized. However, it may be said that in one particular embodiment of the type illustrated in the drawings an optimum incidence angle 43 was determined at about 6.9 degrees which provided an increase in range of about 40% over a conventionally designed diffuser with an incidence angle 43 of about 3.4 degrees relative to the vane suction side 40. There was also an efficiency loss of about ½% which was considered small in view of the gain in range that was obtained.

Discussion

At the present time in the development of this technology, the formation of the stall bubble and the reasons behind it are not fully understood. However, evidence of its existence and proof of the improvement in operating range through the application of the concepts resulting therefrom to compressors and diffusers therefor are now established.

The existence of a stall bubble in the throat of a diffuser was discovered by studying the results of tests of a turbocharger compressor with an experimental diffuser which was designed with a much larger area than was considered practical. The increased area was obtained by utilizing a diffuser vane setting more radial than the predicted gas flow angles would have indicated was practical.

Figure 5:
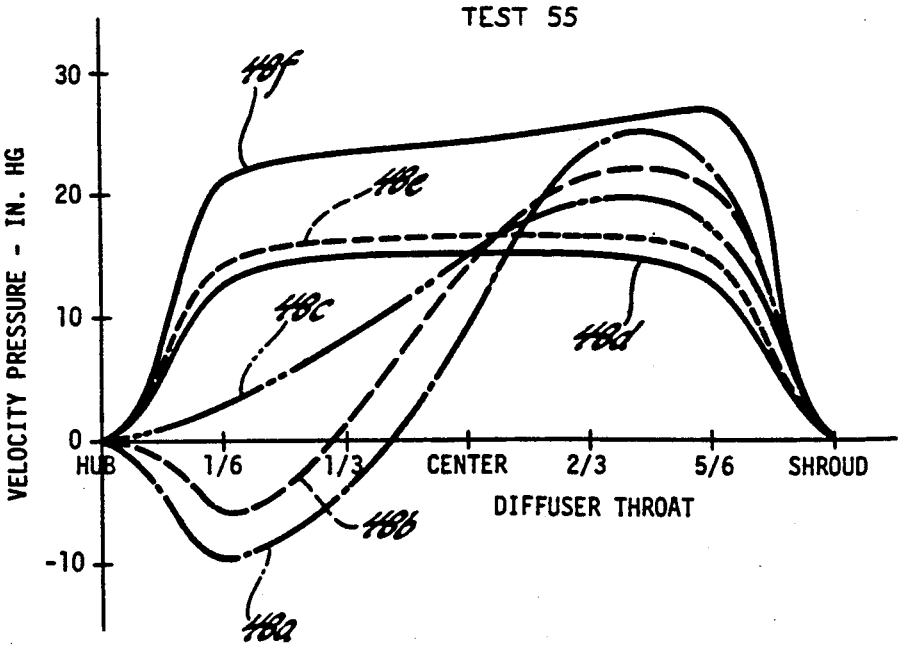
FIG. 5 is a graph of velocity pressure in the diffuser throat at various flow rates for a compressor according to the invention.

FIG. 4 illustrates a map of mass flow versus pressure ratio for the compressor in this test. It produced higher flows than a conventional design as expected but also exhibited a surge line 47 at flows far lower than expected. The results of velocity readings at various points in the diffuser throat under a range of conditions from near surge to choke flow are illustrated in FIG. 5. Six curves 48*a*–48*f* are presented illustrating the conditions from near the surge point 48*a* to near the maximum or choke flow condition at 48*f*. In the high flow range of 48*d*–48*f* the curves follow a normal even distribution pattern of gas flow. However, as flow is reduced, at 48*c* a substantial reduction in flow on the hub side is indicated and at 48*b* and 48*a*, near the surge point, a reversal of dynamic pressure and an apparent flow recirculation or stall is indicated.

Study of these results brought forth the theory that stall bubbles (my name for the apparent form of the stagnant or recirculating flow) on the impeller hub side of the diffuser passages were effectively reducing the diffuser throat area as the compressor mass flow was reduced This caused higher fluid velocities to be maintained in the remaining portions of the diffuser passages and effectively forestalled surge until lower flow rates were reached than expected In effect, the diffuser responded as if it had a much smaller throat area than it actually had.

This theory was supported by inspection of the cover plate of the diffuser after testing which clearly showed soot traces 50 on the hub sides of the diffuser passages These soot traces formed the outline of the stall bubbles, shown in FIG. 3 as extending from the leading edges 35 of the diffuser blades along their suction sides 40, and indicated the stalling condition of the gases forming the stall bubbles 46 along the hub side of the diffuser.

Figure 6:
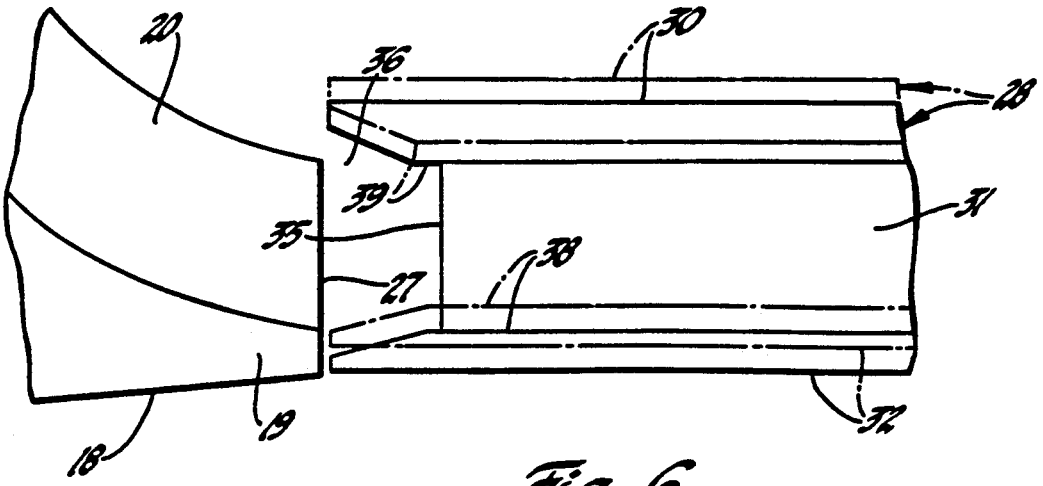
FIG. 6 is a schematic view roughly illustrating various axial positions of the diffuser relative to the impeller in a compressor.

It was felt that if these stall bubbles could be created and destroyed at will, there would be a strong possibility that the factors controlling these bubbles could be determined and optimum AVGD's could be developed. It was theorized that the stall bubbles were created at the hub side of the diffuser passages adjacent the vane leading edges 35 due to the gas flow being more tangential than the suction side 40 of the diffuser vanes. That is, a substantial angle of incidence 43 existed. This theory could be supported by making the flow more radial, which should eliminate the stall bubbles This was done by moving the diffuser axially, as shown by the dashed lines in FIG. 6, so that the flow into the diffuser 28 was pinched somewhat on the hub side 38, causing it to be accelerated and resulting in a more radial flow angle of the gas passing the diffuser vane leading edges.

Figure 8:
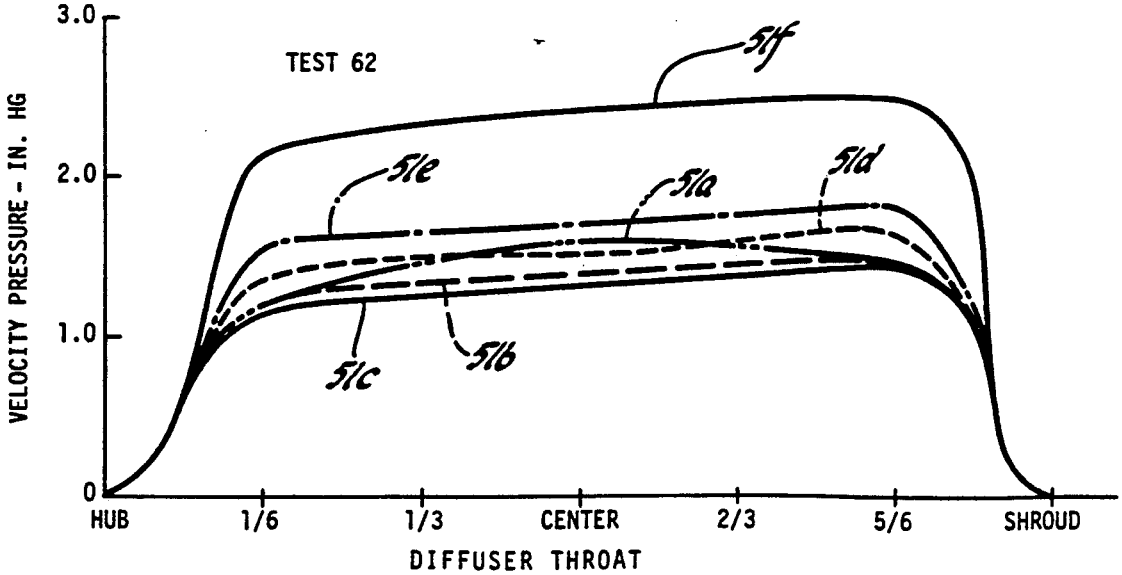
FIG. 8 is a graph similar to FIG. 5 presenting test results from the modified unit of FIG. 7.

The dramatic results are shown in FIG. 7, which shows the compressor flow map for this test, and FIG. 8 showing, with flow curves 51*a*–*f* covering the range from surge to choke flow, the velocity pressure profile in the throat at the leading edge of the diffuser vanes. Here there is no evidence of reverse flow or a stall bubble as compared with FIG. 5. Also, at 16,000 rpm, the range is reduced from 35.2% in FIG. 4 to 24.9% in FIG. 7. Soot trace tests conducted under comparable conditions to those shown in FIG. 3 showed no sign of a soot build up and, thus, tended to confirm the absence of stall bubbles shown by the results of the second tests.

In order to properly evaluate and compare various tests for the development of the stall bubbles on a similar basis it was necessary to develop some sort of a bench mark. A logical point of comparison is when the diffuser throat static pressure, measured on the shroud side, is equal to the diffuser throat total pressure, measured where the stall bubbles occur, which in this case was on the hub side of the diffuser passages. This equality indicates that the dynamic pressure and flow on the hub side have dropped to zero and reverse flow is beginning, indicating the development of stall bubbles.

Thus for each constant speed line, the data for a series of tests was interpolated or extrapolated to determine the flows and the pressure ratios where these pressures were equal. The flows were then converted to specific flow by dividing by the impeller inlet area so that different sized compressors could be compared. These data are plotted in FIG. 9 for tests 52, 54, 55, 56 and 58 which are for one size of turbocharger compressor and for tests 59 and 60 which are for a smaller sized turbocharger compressor.

The slopes of the lines in FIG. 9 were then correlated with the incidence angles at the diffuser vane leading edges under conditions near surge. This correlation is shown in FIG. 10. For comparison, compressor flow maps for tests 52, 54, 55, 56, 58, 59 and 60 are shown FIGS. 11, 12, 4, 13, 14, 15 and 16 respectively.

It should be recognized that the data correlated in FIGS. 9 and 10 are not based upon absolute numbers but rather they are relative quantities derived from the data base and instrumentation used for these tests. It would be possible therefore for individuals with different facilities, equipment and instrumentation to develop curves similar to FIGS. 9 and 10 but substantially shifted in their absolute locations from those presented herein.

Design Considerations

In designing an AVGD, it is worth considering that the adjustment of a mechanically variable geometry diffuser, as the flow moves from choke to surge along a speed line, is critical and must be experimentally determined for a particular machine. Otherwise surge may occur inadvertently. The same kind of control logic must be considered for the AVGD. The initiation of the stall bubble and the rate at which it grows must be controlled as the flow moves from choke to surge to avoid a premature surge. Incorrectly matched diffusers may exhibit two hard surge points along a constant speed line. It should be noted that the lower the slope indicated in a plot similar to FIG. 9, the higher will be the flow rate at which the stall bubbles are first formed. The recognition of this relationship allows the designer to adjust the growth rate of the stall bubbles and the resulting effective reduction in diffuser throat area in a manner to prevent premature surge.

There are four items which affect the flow angle, or incidence angle, relative to the suction side of the diffuser vane, thereby controlling the growth rate of the stall bubble. These are (1) impeller backsweep, (2) radius ratio, (3) shelf or pinch on the hub side, and (4) the suction side angle of the diffuser vanes.

The impeller backsweep usually ranges from 0–45 degrees and is determined by the designer in accordance with conventional design practice.

The radius ratio is the radius of the diffuser vane leading edge from the center of the diffuser divided by the radius of the impeller tips. The radius ratio is actually an area ratio and affects the flow angle because, as a first approximation, the vaneless space between these radii diffuses the radial component of flow while the tangential component is conserved. Therefore, the larger the radius ratio, the more tangential the flow will become.

The shelf or pinch on the hub side is determined by the axial location of the hub side of the diffuser wall relative to the impeller hub. A shelf, as shown by the solid lines in FIG. 6, results in an increase in area which causes the flow to become more tangential. Pinch, shown by the dashed lines in FIG. 6, does the reverse since it reduces the area and accelerates the radial component of flow, resulting in the overall flow becoming more radial.

The first three of these four items affect the direction of the gas flow that impinges on the leading edges 35 at the hub side of the diffuser vanes; however, this direction changes depending upon the rotational speed of the impeller and the rate of gas flow through the compressor, both of which are variable. This angle of gas flow may be theoretically determined in the design of a compressor by methods known in the art and may be empirically evaluated from the results of actual tests conducted under operating conditions in known manner.

The suction side angle of the diffuser vane obviously affects directly the incidence angle 43 between the gas flow and the suction sides 40 of the diffuser vanes, but this vane angle is limited by basic diffuser design criteria if good pressure recoveries bare desired.

Referring to the compressor flow maps of FIGS. 4 and 11–14, it is seen that test 55 of FIG. 4 represents an apparently optimum incidence angle which, as indicated in FIG. 10, is 6.9 degrees. In determination of this optimum, items 2, 3 and 4 of the foregoing list were all varied. Going from test 52 of FIG. 11 to test 54 of FIG. 12, the radius ratio was increased and the diffuser vanes were made more radial. This was also done in moving from test 54 of FIG. 12 to test 55 of FIGS. 4 and 5. Test 62 shown in FIGS. 7 and 8 used pinch on the hub side. Test 56 of FIG. 13 used the maximum possible shelf on the hub side that was allowed by mechanical constraints on the test rig. Test 58 of FIG. 14 adjusted the pinch to a point between that of tests 55 and 56.

The results reported here of testing on the smaller compressor were inadequate to determine what is considered an optimum incidence angle. However, further testing along the lines indicated and analysis of the results can be utilized to find an optimum figure. While, presently, the design process for an AVGD is based strongly upon experimental results, it is expected that, as AVGD's are applied more commonly in the future to existing and new compressors and pumps, the experimental approach can be reduced considerably and a much more direct design approach will become available.

While the invention has been described by reference to certain preferred embodiments of radial flow compressors for compressible fluids, it is believed that the concepts involved are also directly applicable to other fluid machines including other forms of compressors, such as mixed flow types, and similarly configured pumps, such as mixed flow and radial flow centrifugal diffuser pumps. In addition, it should be understood that numerous changes could be made within the spirit and scope of the inventive concepts described. Accordingly it is intended that the invention not be limited to the disclosed embodiments, but that it have the full scope permitted by the language of the following claims.

The embodiments of the invention in which an exclusive property or privilege is claimed are defined as follows:

1. A centrifugal fluid machine having a vaned impeller with a peripheral annular outlet and a vaned diffuser having an annular inlet generally aligned with and surrounding the impeller outlet to receive therefrom fluid flow having velocity and direction varying in part as a function of impeller speed and differential pressure, the diffuser vanes having suction sides trailing in the direction of impeller rotation and being angled so as to be in general alignment with the overall direction of fluid flow during the fluid machine operating range from choke to surge/instability conditions, and the improvement wherein the orientation of the suction sides of the vanes is more radial than the fluid flow direction in the portion of the operating range near the surge/instability condition by an incidence angle sufficient to create stall bubbles along the vanes, suction sides in and adjacent to the throat at the diffuser inlet to forestall surge/instability by effectively fluid dynamically reducing the flow area of the diffuser throat near the surge/instability condition and thereby extending the operating fluid flow range of the fluid machine between the choke and surge/instability conditions, said incidence angle near the surge/instability condition having a value in excess of 3.5 degrees.

2. A centrifugal fluid machine as in claim 1 wherein said incidence angle has a value in the range of from 5 to 9 degrees.

3. A centrifugal fluid machine as in claim 1 wherein the operating flow range of the fluid machine exceeds 30 percent of the flow at choke flow.

4. A centrifugal fluid machine as in claim 3 wherein the operating flow range of the fluid machine is near 35 percent of the flow at choke flow.

5. A centrifugal fluid machine having a vaned impeller with a peripheral annular outlet defined in part by a hub on one side and a shroud on the other and a vaned diffuser having an annular inlet generally aligned with and surrounding the impeller outlet to receive therefrom fluid flow having velocity and direction varying in part as a function of impeller speed and differential pressure, the diffuser vanes having suction sides trailing in the direction of impeller rotation and being angled so as to be in general alignment with the overall direction of fluid flow during the fluid machine operating range from choke to surge/instability conditions, the vanes defining passages closed on opposite hub and shroud sides generally aligned with the impeller hub and the shroud, respectively, and the improvement wherein the orientation of the suction sides of the vanes is more radial than the fluid flow direction in the portion of the operating range near the surge/instability condition by an incidence angle sufficient to create stall bubbles along the vanes, suction sides in and adjacent to the throat on the hub sides of the diffuser passages at the diffuser inlet to forestall surge/instability by effectively fluid dynamically reducing the flow area of the diffuser throat near the surge/instability condition and thereby extending the operating fluid flow range of the fluid machine between the choke and surge/instability conditions, said incidence angle near the surge/instability condition having a value in excess of 3.5 degrees.

6. A centrifugal fluid machine as in claim 5 wherein said incidence angle has a value in the range from 5 to 9 degrees.

7. A centrifugal fluid machine as in claim 5 wherein the operating flow range of the fluid machine exceeds 30 percent of the flow at choke flow.

8. A centrifugal fluid machine as in claim 7 wherein the operating flow range of the fluid machine is near 35 percent of the flow at choke flow.

* * * * *